US009932866B2

(12) United States Patent
Matsunaga

(10) Patent No.: US 9,932,866 B2
(45) Date of Patent: Apr. 3, 2018

(54) VALVE TIMING CONTROLLER

(71) Applicant: DENSO CORPORATION, Kariya, Aichi-pref. (JP)

(72) Inventor: Yuuki Matsunaga, Kariya (JP)

(73) Assignee: DENSO CORPORATION, Kariya (JP)

( * ) Notice: Subject to any disclaimer, the term of this patent is extended or adjusted under 35 U.S.C. 154(b) by 0 days.

(21) Appl. No.: 15/232,075

(22) Filed: Aug. 9, 2016

(65) Prior Publication Data

US 2017/0074126 A1 Mar. 16, 2017

(30) Foreign Application Priority Data

Sep. 11, 2015 (JP) ..... 2015-180002

(51) Int. Cl.
*F01L 1/34* (2006.01)
*F01L 1/344* (2006.01)
*F01L 1/047* (2006.01)

(52) U.S. Cl.
CPC ..... *F01L 1/344* (2013.01); *F01L 1/047* (2013.01); *F01L 1/3442* (2013.01); *F01L 2001/34483* (2013.01); *F01L 2250/02* (2013.01)

(58) Field of Classification Search
CPC ..... F01L 1/344; F01L 1/047; F01L 1/3442; F01L 2001/34483; F01L 2250/02
See application file for complete search history.

(56) References Cited

U.S. PATENT DOCUMENTS

2005/0115528 A1* 6/2005 Imaizumi ..... F01L 1/022 123/90.17
2007/0215085 A1 9/2007 Imaizumi et al.
2014/0069361 A1* 3/2014 Watanabe ..... F01L 1/053 123/90.15

FOREIGN PATENT DOCUMENTS

JP 60-194635 12/1985

* cited by examiner

*Primary Examiner* — Zelalem Eshete
(74) *Attorney, Agent, or Firm* — Nixon & Vanderhye PC

(57) ABSTRACT

A valve timing controller includes: an outer rotor; an inner rotor relatively rotating inside of the outer rotor; a torsion coil spring having a fixed end connected with the inner rotor, and a free end connected with the outer rotor; and a bush rotor coaxially projected from the outer rotor or the inner rotor to support the torsion coil spring in a radial direction. The torsion coil spring biases the inner rotor while being connected with the outer rotor by being torsionally deformed according to a relative rotation of the inner rotor to the outer rotor. A load acting from a first turn of the torsion coil spring adjacent to the free end is smaller than a load acting from a wound part of the torsion coil spring between the first turn and the fixed end.

6 Claims, 13 Drawing Sheets

VALVE TIMING CONTROLLER

CROSS REFERENCE TO RELATED APPLICATION

This application is based on Japanese Patent Application No. 2015-180002 filed on Sep. 11, 2015, the disclosure of which is incorporated herein by reference in its entirety.

TECHNICAL FIELD

The present disclosure relates to a valve timing controller.

BACKGROUND

A valve timing controller includes an outer rotor and an inner rotor rotating with a crankshaft and a camshaft, respectively, around a rotation axis. The inner rotor is relatively rotated inside the outer rotor to control valve timing according to the rotation phase between the outer rotor and the inner rotor by the relative rotation.

JP 4487957 B2 (corresponding to US 2007/0215085 A1) describes a valve timing controller equipped with a torsion coil spring wound in the shape of coil around a rotation axis. The torsion coil spring has a fixed end connected with the inner rotor, and a free end connected with the outer rotor. The torsion coil spring biases the inner rotor while being connected with the outer rotor by being twistingly deformed according to the relative rotation of the inner rotor to the outer rotor. Thereby, while an internal-combustion engine is stopped, the rotation phase can be forced to a phase suitable for starting due to the biasing force of the torsion coil spring. As a result, an expected valve timing will be realized.

The valve timing controller further includes a bush rotor projected coaxially from the inner rotor. The bush rotor supports the torsion coil spring in the radial direction to stabilize the biasing force of the torsion coil spring. The bush rotor has a cylindrical shape with a center axis aligned with the rotation axis. The torsion coil spring is a wound coil having a center axis aligned with the rotation axis. Since the orientation of the torsion coil spring supported by the bush rotor becomes difficult to change, it becomes possible to realize a predetermined valve timing by restricting the biasing force from being affected.

SUMMARY

However, the first turn of the torsion coil spring adjacent to the free end is displaced relative to the rotation axis due to the torsional deformation. The first turn adjacent to the free end may be pressed onto the bush rotor by the displacement. As a result, since the torsion coil spring receives stress concentration at the pressed position, the torsion coil spring may suffer fatigue destruction due to the repetition of the stress concentration.

It is an object of the present disclosure to provide a valve timing controller with high durability.

According to an aspect of the present disclosure, a valve timing controller that controls a valve timing of a valve opened and closed by a camshaft based on torque transfer from a crankshaft in an internal-combustion engine includes: an outer rotor that rotates with the crankshaft around a rotation axis; an inner rotor that rotates with the camshaft around the rotation axis, the inner rotor relatively rotating inside of the outer rotor; a torsion coil spring having a coil shape wound around the rotation axis, the torsion coil spring having a fixed end connected with the inner rotor, and a free end connected with the outer rotor, the torsion coil spring biasing the inner rotor while being connected with the outer rotor by being tortionally deformed according to a relative rotation of the inner rotor to the outer rotor; and a bush rotor coaxially projected from the outer rotor or the inner rotor. The bush rotor supports the torsion coil spring in a radial direction. A load acting from a first turn of the torsion coil spring adjacent to the free end is smaller than a load acting from a wound part of the torsion coil spring that is located between the first turn and the fixed end.

Accordingly, the first turn adjacent to the free end is displaced relative to the rotation axis by the torsional deformation, and is pressed onto the bush rotor. At this time, the load which acts on the bush rotor by the first turn of the torsion coil spring adjacent to the free end is smaller than the load which acts on the bush rotor from the wound part between the fixed end and the first turn adjacent to the free end. Therefore, the stress concentration can be reduced in the torsion coil spring at the position pressed onto the bush rotor. Thus, the torsion coil spring can be restricted from having fatigue destruction by repetition of such stress concentration, so as to improve the durability.

The bush rotor may support the torsion coil spring inside of the bush rotor. When a specific position is defined at a circumferential position opposite to the free end through the rotation axis, the load acting from the first turn adjacent to the free end to the bush rotor is smaller than the load acting from the wound part, at the specific position.

Accordingly, when the torsion coil spring is torsionally deformed inside of the bush rotor, the first turn adjacent to the free end is easily displaced away from the free end through the rotation axis. As a result, the first turn adjacent to the free end is easily pressed onto the bush rotor at the specific position defined as a circumferential position opposite to the free end through the rotation axis. At this time, at the specific position of the torsion coil spring, the load which acts on the bush rotor from the first turn adjacent to the free end is smaller than the load which acts on the bush rotor from the wound part between the fixed end and the first turn adjacent to the free end. According to this, the stress concentration can be reduced at the position where the torsion coil spring is pressed. Therefore, the torsion coil spring can be restricted from having fatigue destruction by reducing the stress concentration, and the high durability can be secured.

The bush rotor may support the torsion coil spring outside of the bush rotor. When a specific position is defined at a circumferential position at which the free end is set, the load acting from the first turn adjacent to the free end to the bush rotor is smaller than the load acting from the wound part, at the specific position.

Accordingly, when the torsion coil spring is torsionally deformed outside of the bush rotor, the first turn adjacent to the free end is easily displaced away from the free end through the rotation axis. As a result, the first turn adjacent to the free end is easily pressed onto the bush rotor at the specific position defined as the circumferential position where the free end is set. At this time, the load which acts on the bush rotor from the first turn adjacent to the free end is smaller than the load which acts on the bush rotor from the wound part between the fixed end and the first turn adjacent to the free end, at the specific position of the torsion coil spring. According to this, the stress concentration can be reduced at the position where the torsion coil spring is pressed. Therefore, the torsion coil spring can be restricted from having fatigue destruction by reducing the stress concentration, and the high durability can be secured.

BRIEF DESCRIPTION OF THE DRAWINGS

The above and other objects, features and advantages of the present disclosure will become more apparent from the following detailed description made with reference to the accompanying drawings. In the drawings.

DETAILED DESCRIPTION

Figure 1:
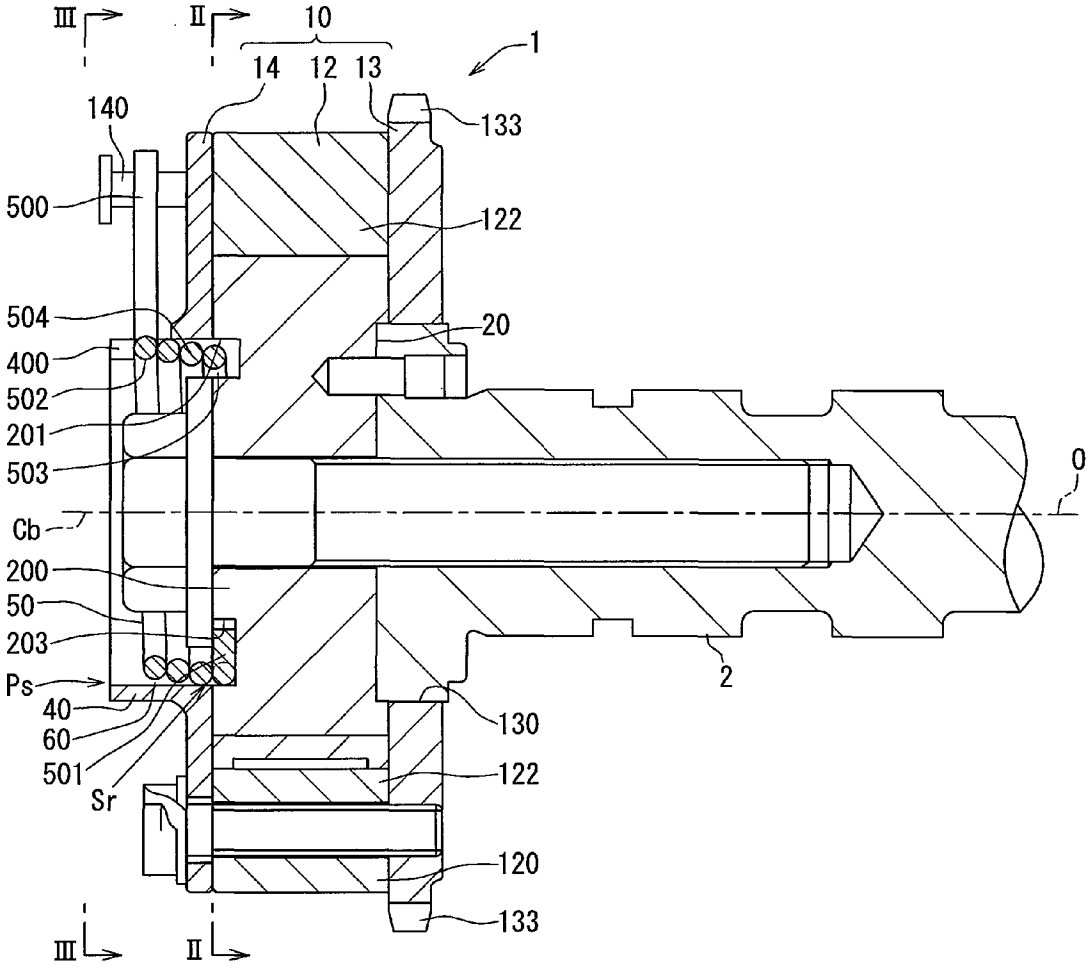
FIG. 1 is a sectional view illustrating a valve timing controller according to a first embodiment.

Embodiments of the present disclosure will be described hereafter referring to drawings. In the embodiments, a part that corresponds to a matter described in a preceding embodiment may be assigned with the same reference numeral, and redundant explanation for the part may be omitted. When only a part of a configuration is described in an embodiment, another preceding embodiment may be applied to the other parts of the configuration. The parts may be combined even if it is not explicitly described that the parts can be combined. The embodiments may be partially combined even if it is not explicitly described that the embodiments can be combined, provided there is no harm in the combination.

(First Embodiment)

Figure 2:
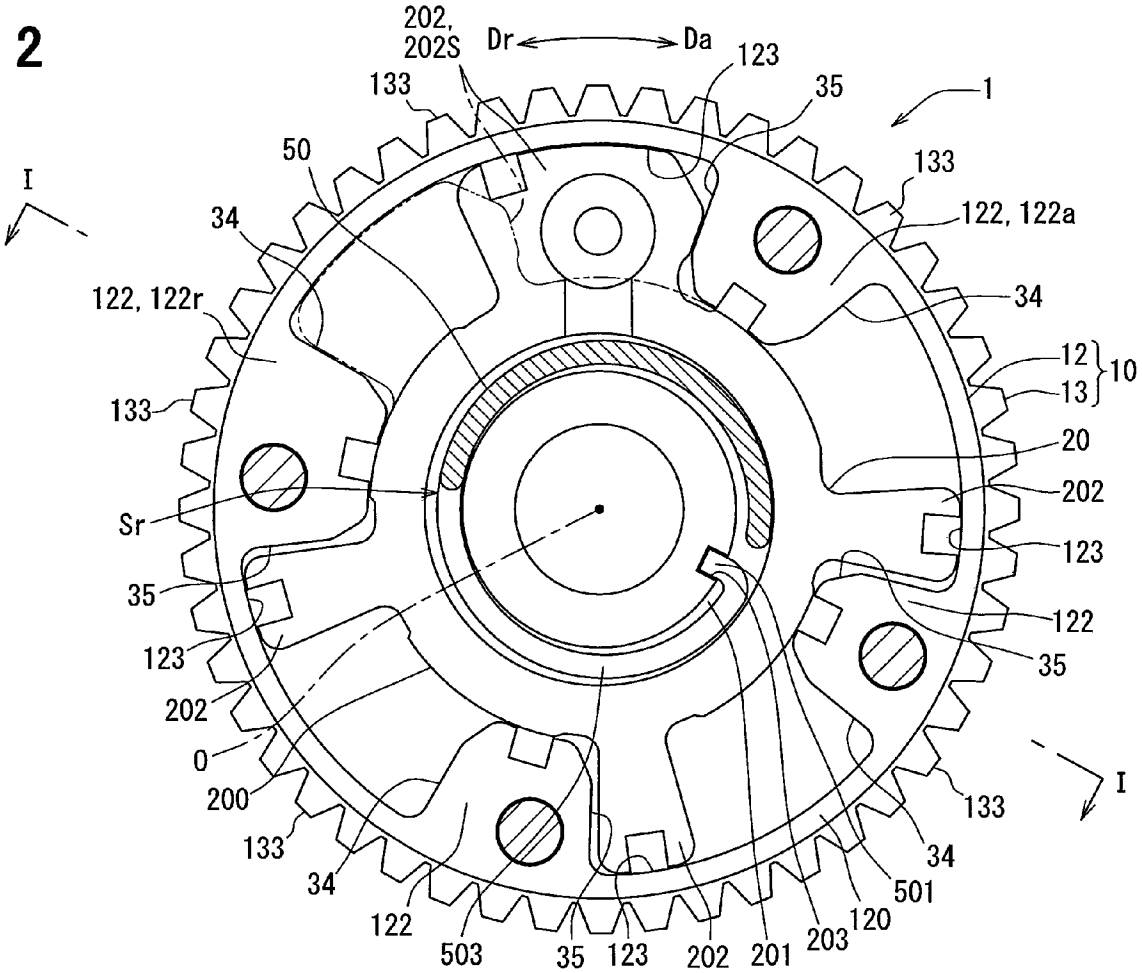
FIG. 2 is a cross-sectional view taken along a line II-II of FIG. 1.

As shown in FIG. 1 which is a cross-sectional view taken along a line I-I of FIG. 2, a valve timing controller 1 according to a first embodiment is a hydraulic controller using pressure of operation oil. The valve timing controller 1 is installed in a transfer system where a crank torque output from a crankshaft is delivered to a camshaft 2 in an internal-combustion engine. The camshaft 2 drives an exhaust valve to open or close by transfer of the crank torque from the crankshaft. The valve timing controller 1 controls the valve timing of a valve such as the exhaust valve.

As shown in FIGS. 1-4, the valve timing controller 1 includes an outer rotor 10, an inner rotor 20, a bush rotor 40, and a torsion coil spring 50. The valve timing controller 1 controls the valve timing according to a rotation phase between the outer rotor 10 and the inner rotor 20 by relatively rotating the inner rotor 20 with operation oil inside of the outer rotor 10.

The outer rotor 10 is a housing rotor. Specifically, the outer rotor 10 is made of metal, and has a shoe housing 12, a sprocket plate 13 and a cover plate 14 screwed to the axial ends of the shoe housing 12 respectively. As shown in FIGS. 1 and 2, the shoe housing 12 has an accommodation pipe 120 and plural shoes 122. Each shoe 122 is projected with an approximately sector shape inward in the radial direction from the accommodation pipe 120 at positions spaced in the circumferential direction at a predetermined interval. An accommodation chamber 123 is formed between the shoes 122 adjacent to each other in the circumferential direction.

As shown in FIGS. 1-4, the sprocket plate 13 has sprocket teeth 133. Each sprocket tooth 133 is projected with an approximately sector shape outward in the radial direction from the sprocket plate 13 at positions spaced in the circumferential direction at a regular interval. A timing chain is engaged with the sprocket teeth 133 and teeth of the crankshaft, such that the sprocket plate 13 is engaged with the crankshaft. Thereby, the sprocket plate 13 receives the crank torque from the crankshaft through the timing chain during the operation of the internal-combustion engine. At this time, the outer rotor 10 rotates to one side (clockwise rotation in FIGS. 2 and 3) with the crankshaft in the circumferential direction around the rotation axis O.

As shown in FIG. 1, the sprocket plate 13 has a main hole 130 passing through the sprocket plate 13 in the axial direction. The sprocket plate 13 is supported by the camshaft 2 coaxially fitted to the main hole 130.

Figure 3:
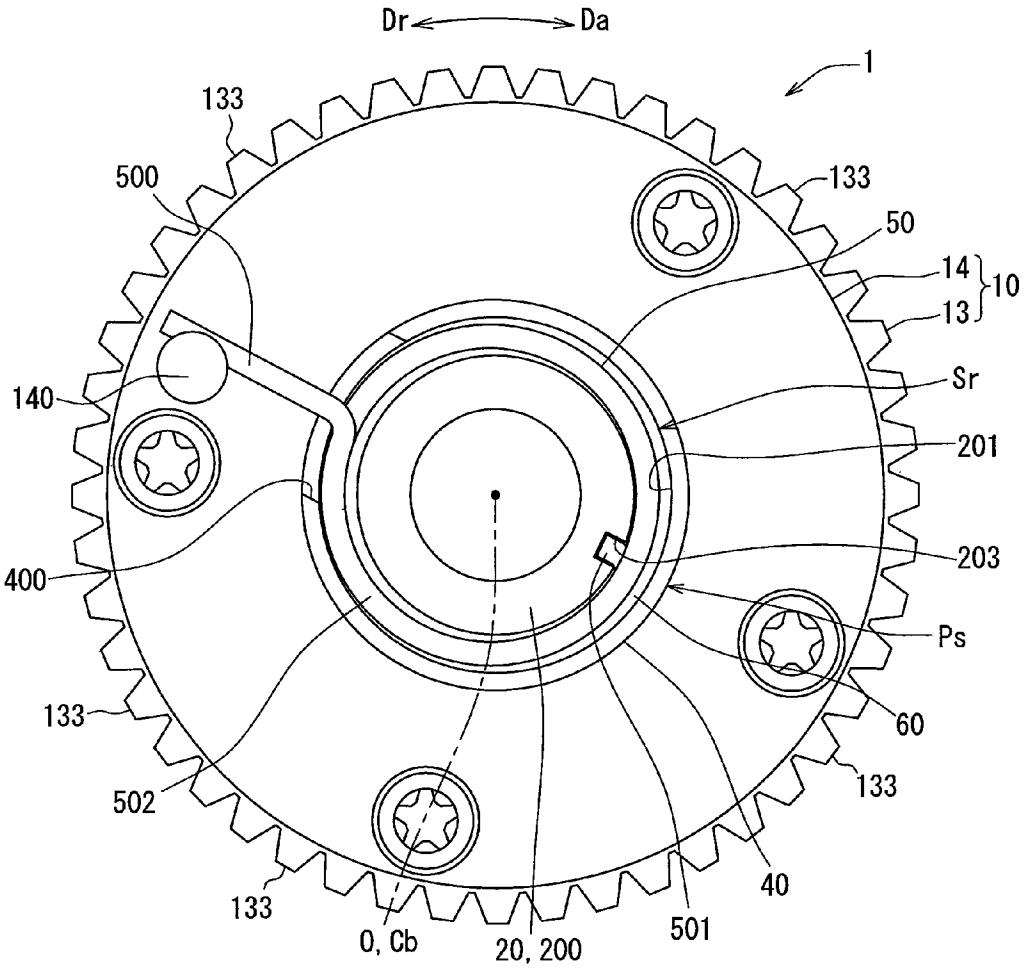
FIG. 3 is a cross-sectional view taken along a line III-III of FIG. 1.
Figure 4:
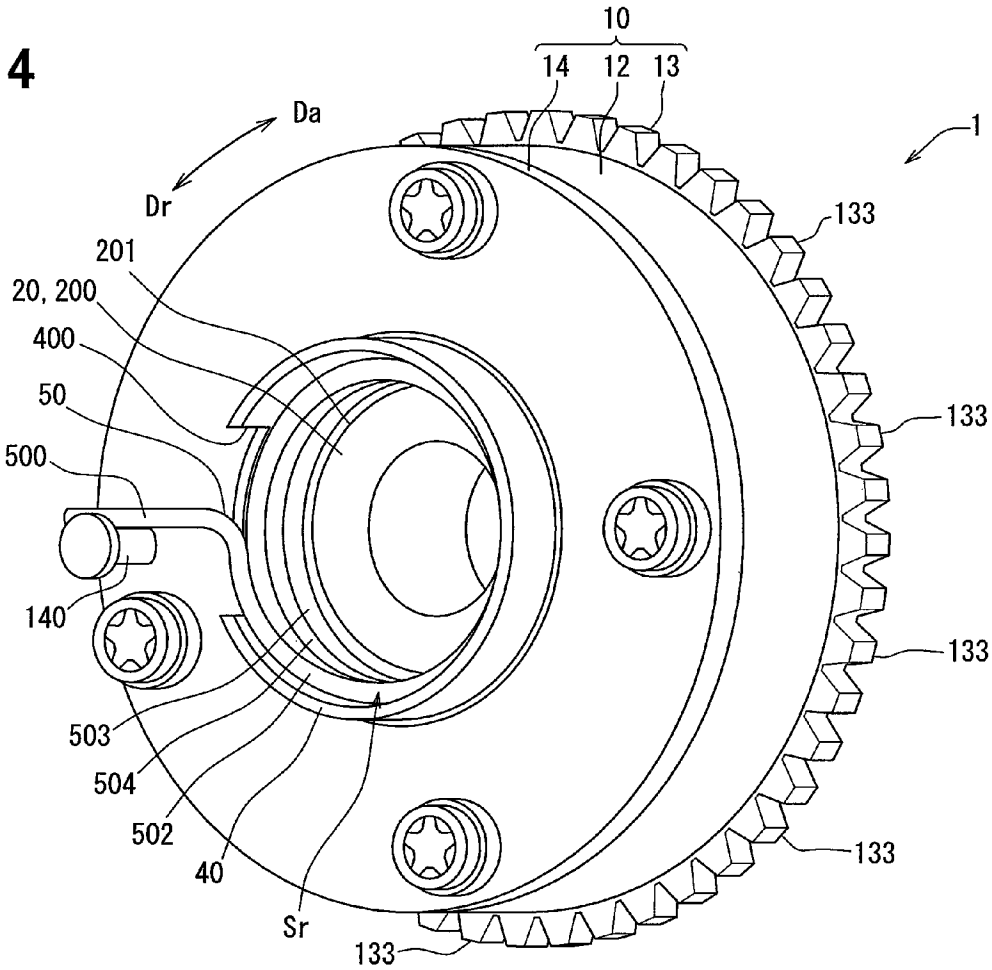
FIG. 4 is a perspective view illustrating the valve timing controller.

As shown in FIGS. 1, 3, and 4, the cover plate 14 has a connection stopper 140. The connection stopper 140 has a pillar pin shape arranged to be eccentric to the rotation axis O. The connection stopper 140 is projected outward from an end surface of the cover plate 14 opposite from the shoe housing 12 in the axial direction.

As shown in FIGS. 1-4, the inner rotor 20 is a vane rotor made of metal and held in the outer rotor 10.

The inner rotor 20 has a rotation shaft 200 and plural vanes 202. The rotation shaft 200 has a cylindrical shape arranged coaxially inside the outer rotor 10. The rotation shaft 200 has an annular recess portion 201 and a connection groove portion 203. The annular recess portion 201 is formed as a ring slot opened toward the cover plate 14 in the axial direction. The connection groove portion 203 is formed as a rectangle slot opened to the inside of the annular recess portion 201. In other words, the connection groove portion 203 is defined in the internal surface of the annular recess portion 201.

As shown in FIG. 1, the rotation shaft 200 is connected with the camshaft 2 inserted coaxially inside the outer rotor 10 through the main hole 130. The inner rotor 20 rotates to one side (clockwise rotation in FIGS. 2 and 3) in the circumferential direction with the camshaft 2 around the rotation axis O during the operation of the internal-combustion engine. At this time, the inner rotor 20 is able to rotate relative to the outer rotor 10 on the both sides in the circumferential direction. While the inner rotor 20 and the outer rotor 10 are relatively rotated, one end and the other end of the rotation shaft 200 in the axial direction are respectively made to slide on the sprocket plate 13 and the cover plate 14. Further, an outer circumference of the rotation shaft 200 is made to slide on the projection tip end of each shoe 122 in the radial direction.

As shown in FIG. 2, each vane 202 is projected with the shape of approximately sector outward in the radial direction from the rotation shaft 200 at positions spaced at a predetermined interval in the circumferential direction. Each vane 202 is projected into the corresponding accommodation chamber 123. One end and the other end of each vane 202 in the axial direction are made to slide on the sprocket plate 13 and the cover plate 14, respectively, during the relative rotation between the outer rotor 10 and the inner rotor 20. The projection tip end of each vane 202 is made to slide on the inner circumference of the accommodation pipe 120 in the radial direction.

Inside of the outer rotor 10, each vane 202 partitions the corresponding accommodation chamber 123 in the circumferential direction, such that an advance operation chamber 34 and a retard operation chamber 35 are formed by each vane 202. When operation oil is introduced from a pump to each advance operation chamber 34 by the operation of an oil pressure control valve, the running torque is generated in the internal-combustion engine to relatively rotate the inner rotor 20 on the advance side Da in the circumferential direction relative to the outer rotor 10. At this time, in the internal-combustion engine, operation oil is drained from each retard operation chamber 35 by the operation of the oil pressure control valve. Thus, the rotation phase of the inner rotor 20 to the outer rotor 10 is advanced to advance the valve timing.

On the other hand, in the internal-combustion engine, when operation oil is introduced from a pump to each retard operation chamber 35 by the operation of oil pressure control valve, the running torque occurs to relatively rotate the inner rotor 20 on the retard side Dr in the circumferential direction relative to the outer rotor 10. At this time, operation oil is drained from each advance operation chamber 34 by the operation of the oil pressure control valve in the internal-combustion engine, such that the rotation phase is retarded to retard the valve timing.

A stopper vane 202S is specific one of the vanes 202, and is projected into the accommodation chamber 123 between the stopper shoes 122*a*, 122*r* which are specific two of the shoes 122. As shown in the solid line in FIG. 2, the advance stopper shoe 122*a* is in contact with the stopper vane 202S rotated relative to the outer rotor 10 on the advance side Da in the circumferential direction, thereby stops the motion of the inner rotor 20 to the advance side Da. Thus, the rotation phase is restricted from changing to the advance side Da at the maximum advance phase. On the other hand, as shown in the two-point chain line of FIG. 2, the retard stopper shoe 122*r* is in contact with the stopper vane 202S relatively rotated to the outer rotor 10 on the retard side Dr in the circumferential direction, thereby stops the motion of the inner rotor 20 to the retard side Dr. The rotation phase is restricted from changing to the retard side Dr at the maximum retard phase. Accordingly, the relatively rotatable range of the inner rotor 20 to the outer rotor 10 is set as a range from the maximum advance phase to the maximum retard phase.

As shown in FIGS. 1 and 3-5, the bush rotor 40 is formed in the cylinder shape with a center axis Cb aligned with the rotation axis O, and is made of metal. The bush rotor 40 is coaxially projected out of the outer rotor 10 from the end surface of the cover plate 14 opposite from the shoe housing 12 in the axial direction. Therefore, during the operation of the internal-combustion engine, the bush rotor 40 rotates integrally with the outer rotor 10 to one side (clockwise rotation in FIG. 2) in the circumferential direction around the rotation axis O. The bush rotor 40 of this embodiment is integrally formed with the cover plate 14. Alternatively, the bush rotor 40 may be fixed to the cover plate 14 to be able to integrally rotate after the cover plate 14 is formed separately.

As shown in FIGS. 1, 3, and 4, the bush rotor 40 has a cutout window 400 opposite side of the cover plate 14 in the axial direction. The cutout window 400 is formed in an arc cutout opened to the axially projection side, the radially inner side, and the radially outer side in the bush rotor 40. Thereby, the cutout window 400 is arranged at a circumferential position opposite to a specific position Ps (to be described later) through the rotation axis O. In other words, the position of the cutout window 400 corresponds to the free end 500 of the torsion coil spring 50, in the circumferential position of the bush rotor 40 around the rotation axis O.

As shown in FIGS. 1-5, the torsion coil spring 50 is a kind of torsion spring produced by winding a wire made of metal in the shape of a coil around the rotation axis O. The torsion coil spring 50 is arranged to be located from the inside to the outside of the outer rotor 10. The torsion coil spring 50 has the free end 500 and the fixed end 501 defined by, respectively the both ends of the wire. The torsion coil spring 50 of this embodiment is partially accommodated inside the bush rotor 40 except for the free end 500 and the fixed end 501. The bush rotor 40 supports the torsion coil spring 50 inside the bush rotor 40 in the radial direction.

As shown in FIGS. 1, 3, and 4, the free end 500 is positioned out of the outer rotor 10. The free end 500 is bent to extend to the outer circumference from the first turn 502 adjacent to the free end 500, and is extended to the outer circumference of the bush rotor 40 through the cutout window 400. The connection stopper 140 supports and stops the free end 500 from the retard side Dr, and the free end 500 is connected with the outer rotor 10. Thereby, the free end 500 is restricted from moving on the retard side Dr relative to the outer rotor 10, and is flexibly movable on the advance side Da. The specific position Ps is defined at a set position opposite to the free end 500 through the rotation axis O, in the circumferential position around the rotation axis O.

As shown in FIGS. 1-3, the fixed end 501 is arranged inside the outer rotor 10. The fixed end 501 is bent toward the inner circumference from the first turn 503 adjacent to the fixed end 501, and is extended to the inner circumference from the annular recess portion 201 in which the first turn 503 is received. The fixed end 501 is fitted to the connection groove portion 203, and is connected with the inner rotor 20. Thereby, the fixed end 501 is in the fixed state where both the motion on the retard side Dr and the motion on the advance side Da are always stopped relative to the inner rotor 20.

Under such condition, when the inner rotor 20 is relatively rotated on the retard side Dr relative to the outer rotor 10, the torsion coil spring 50 twists and is deformed according to the relative rotation. At this time, the restoring force of the torsion coil spring 50 acts on the retard side Dr to the outer rotor 10, and acts on the advance side Da to the inner rotor 20. Thereby, the torsion coil spring 50 biases the inner rotor 20 on the advance side Da relative to the outer rotor 10 in the whole region of the relatively rotatable range, while maintaining cooperation with the outer rotor 10.

Under cooperation with the outer rotor 10 and the inner rotor 20, the torsion coil spring 50 becomes the maximum restoration state Sr shown in FIGS. 1-5, and 6A where the torsion coil spring 50 is restored to the maximum when the rotation phase between the rotors 10 and 20 reaches the maximum advance phase. When the rotation phase between the rotors 10 and 20 reaches the maximum retard phase, the torsion coil spring 50 becomes in the maximum deformation state St shown in FIG. 6C where the torsion coil spring 50 is twisted and deformed to the maximum.

The details of the torsion coil spring 50 according to the first embodiment are explained.

Figure 5:
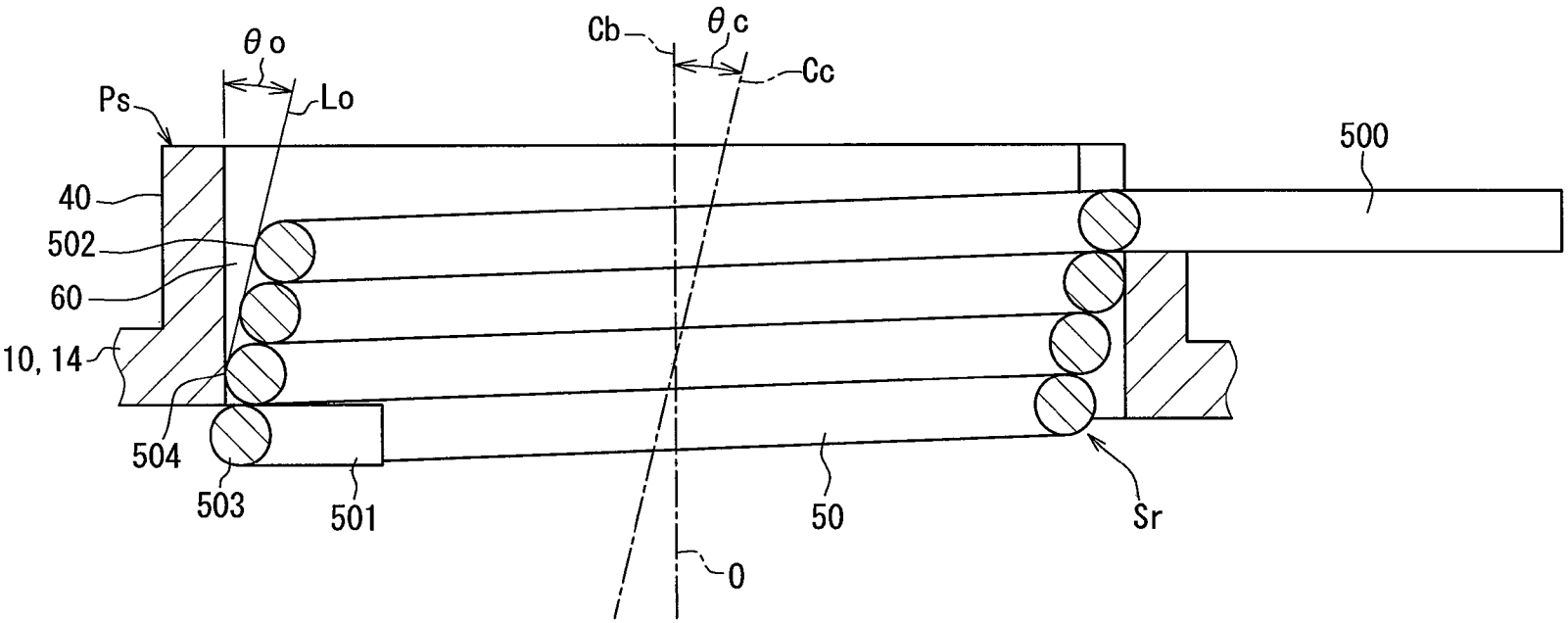
FIG. 5 is an enlarged sectional view illustrating a torsion coil spring of the valve timing controller.

As shown in FIG. 5, the torsion coil spring 50 has a coil axis Cc inclined to the rotation axis O of both the rotors 10 and 20 toward the free end 500. That is, the torsion coil spring 50 is wound in the shape of an odd-form coil. In this embodiment, the torsion coil spring 50 is wound in the shape of the odd-form coil inclined, while the diameter of the coil is substantially fixed, between the free end 500 and the fixed end 501. The inclination angle θc of the coil axis Cc relative to the rotation axis O is approximately coincident with the inclination angle θo of a tangent Lo circumscribed to the torsion coil spring 50 relative to the rotation axis O at the specific position Ps in the maximum restoration state Sr shown in FIGS. 5 and 6A.

Therefore, while the torsion coil spring 50 is connected with both the rotors 10 and 20, as shown in FIGS. 1, 3, 5, and 6A, a clearance 60 is defined between the first turn 502 of the torsion coil spring 50 adjacent to the free end 500 and the bush rotor 40 at the specific position Ps in the maximum restoration state Sr. At this time, at the specific position Ps in the maximum restoration state Sr, the second turn adjacent to the fixed end 501 is in contact with the bush rotor 40 as the wound part 504 of the torsion coil spring 50 between the first turn 502 adjacent to the free end 500 and the fixed end 501. At the specific position Ps in such maximum restoration state Sr, the load Fa which acts on the bush rotor 40 from the first turn 502 adjacent to the free end 500 is smaller than the load Fb which acts on the rotor 40 from the wound part 504 between the first turn 502 adjacent to the free end 500 and the fixed end 501. That is, the load relation of Fa<Fb is satisfied.

Figure 6A:
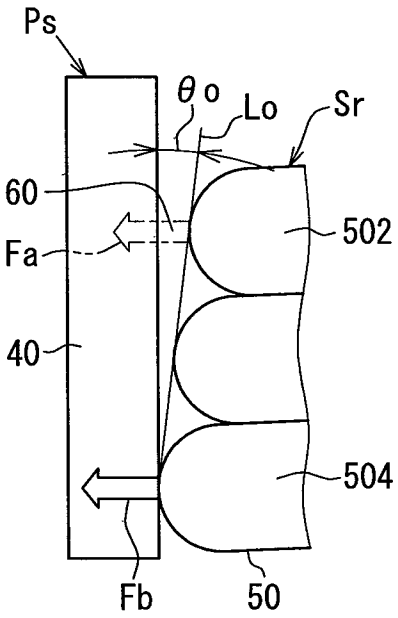
FIG. 6A is a schematic view explaining an operation state of the torsion coil spring.

The load Fa that acts on the bush rotor 40 from the first turn 502 at the specific position Ps in the maximum restoration state Sr is substantially zero or minute due to the clearance 60. In FIG. 6A, the virtual line arrow (namely, two-point chain line) schematically shows the load Fa.

Figure 6B:
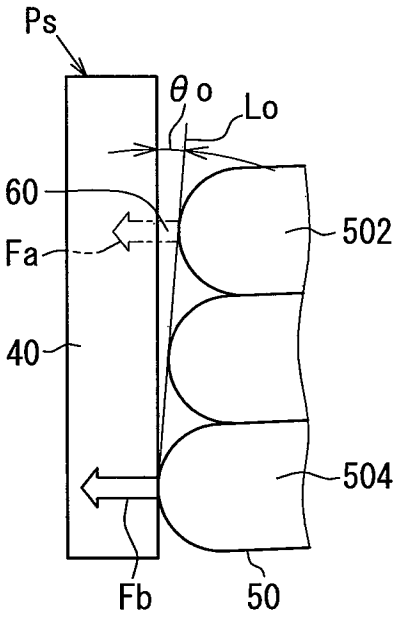
FIG. 6B is a schematic view explaining an operation state of the torsion coil spring.
Figure 6C:
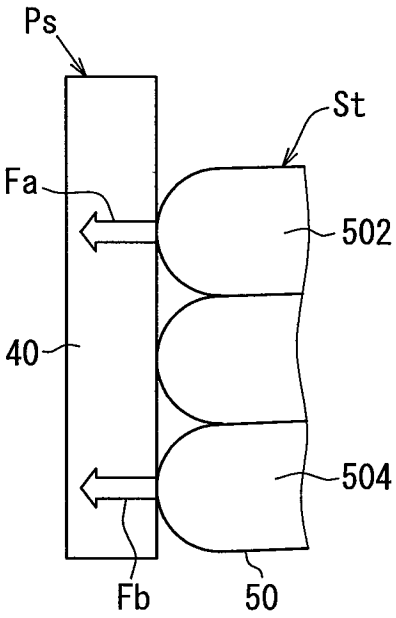
FIG. 6C is a schematic view explaining an operation state of the torsion coil spring.

Furthermore, in the process where the torsional deformation advances from the maximum restoration state Sr of FIG. 6A to FIGS. 6B and 6C in this order, the first turn 502 of the torsion coil spring 50 adjacent to the free end 500 is displaced to approach the bush rotor 40 at the specific position Ps. The load Fa which acts from the first turn 502 is smaller than the load Fb which acts from the wound part 504 even at the specific position Ps of the bush rotor 40 in the process where the torsional deformation advances.

When the torsional deformation advances as shown in FIG. 6B, the inclination angle θo of the tangent Lo to the rotation axis O decreases, and the clearance 60 between the first turn 502 and the bush rotor 40 also decreases. However, also at this time, the load Fa is substantially zero or minute, that is, smaller than the load Fb at the specific position Ps. Also in FIG. 6B, the virtual line arrow (namely, two-point chain line) schematically shows the load Fa. Moreover, while the torsional deformation advances to the maximum deformation state St shown in FIG. 6C from a middle deformation state shown in FIG. 6B, the first turn 502 contacts the bush rotor 40 at the specific position Ps. While the first turn 502 contacts the bush rotor 40, the load relation of Fa<Fb is maintained in this embodiment.

Advantages of the first embodiment are explained below.

According to the first embodiment, the first turn 502 of the torsion coil spring 50 adjacent to the free end 500 is displaced relative to the rotation axis O in connection with the torsional deformation, and is pressed onto the bush rotor 40. At this time, the load Fa which acts on the bush rotor 40 from the first turn 502 of the torsion coil spring 50 adjacent to the free end 500 is smaller than the load Fb which acts on the bush rotor 40 from the wound part 504 between the fixed end 501 and the first turn 502 adjacent to the free end 500. Therefore, the stress concentration can be reduced in the torsion coil spring 50 at the position pressed onto the bush rotor 40. Thus, fatigue destruction of the torsion coil spring 50 can be reduced by restricting the repetition of such stress concentration, such that the durability can be improved.

Moreover, the first turn 502 is easily displaced away from the free end 500 through the rotation axis O when the torsion coil spring 50 is torsionally deformed on the outer circumference of the bush rotor 40. As a result, the first turn 502 is easily pressed onto the bush rotor 40 at the specific position Ps defined as the circumferential position opposite to the free end 500 through the rotation axis O. At this time, at the specific position Ps of the torsion coil spring 50, the load Fa which acts on the bush rotor 40 from the first turn 502 is smaller than the load Fb which acts on the bush rotor 40 from the wound part 504. According to this, the stress concentration can be reduced in the torsion coil spring 50 at the position pressed onto. Therefore, the fatigue destruction of the torsion coil spring 50 can be reduced by easing the stress concentration, such that the high durability is secured.

While the torsion coil spring 50 is connected with both the rotors 10 and 20, at the specific position Ps of the torsion coil spring 50 set to the maximum restoration state Sr, the load Fa which acts on the bush rotor 40 from the first turn 502 is smaller than the load Fb which acts on the bush rotor 40 from the wound part 504. Thus, the stress concentration can be reduced at the position pressed onto the bush rotor 40, not only for the torsion coil spring 50 in the maximum restoration state Sr, but also for the torsion coil spring 50 in the process advancing from the maximum restoration state Sr to the torsional deformation state Sr. Therefore, the fatigue destruction of the torsion coil spring 50 can be reduced irrespective of the rotation phase between the rotors 10 and 20, such that the high durability is attained.

At the specific position Ps of the torsion coil spring 50 set to the maximum restoration state Sr while connected with both the rotors 10 and 20, the wound part 504 is in contact with the bush rotor 40, and the clearance 60 is defined between the bush rotor 40 and the first turn 502. As a result, at the specific position Ps, the load Fa which acts on the bush rotor 40 from the first turn 502 is secured to be smaller than the load Fb which acts on the bush rotor 40 from the wound part 504. Therefore, for the torsion coil spring 50, the stress concentration can be certainly restricted at the position forced onto the bush rotor 40 in the process advancing from the maximum restoration state Sr to the torsional deformation state. Thus, it becomes possible to reliably secure the high durability by effectively controlling the fatigue destruction of the torsion coil spring 50.

In addition, the bush rotor 40 has the cylindrical shape with the center axis Cb aligned with the rotation axis O, and supports the torsion coil spring 50 in the radial direction. The torsion coil spring 50 is an odd-form coil having the coil axis Cc inclined toward the free end 500 relative to the rotation axis O. At the specific position Ps of the torsion coil spring 50 set into the maximum restoration state Sr while being connected with both the rotors 10 and 20, the wound part 504 is in contact with the bush rotor 40, and the clearance 60 can be secured between the first turn 502 and the bush rotor 40. Therefore, the load Fa which acts on the bush rotor 40 from the first turn 502 can be easily secured to be smaller than the load Fb which acts on the bush rotor 40 from the wound part 504 at the specific position Ps. Thus, the bush rotor 40 having the cylindrical shape and the torsion coil spring 50 having the inclined shape of odd-form coil are effective for securing the high durability.

(Second Embodiment)

Figure 7:
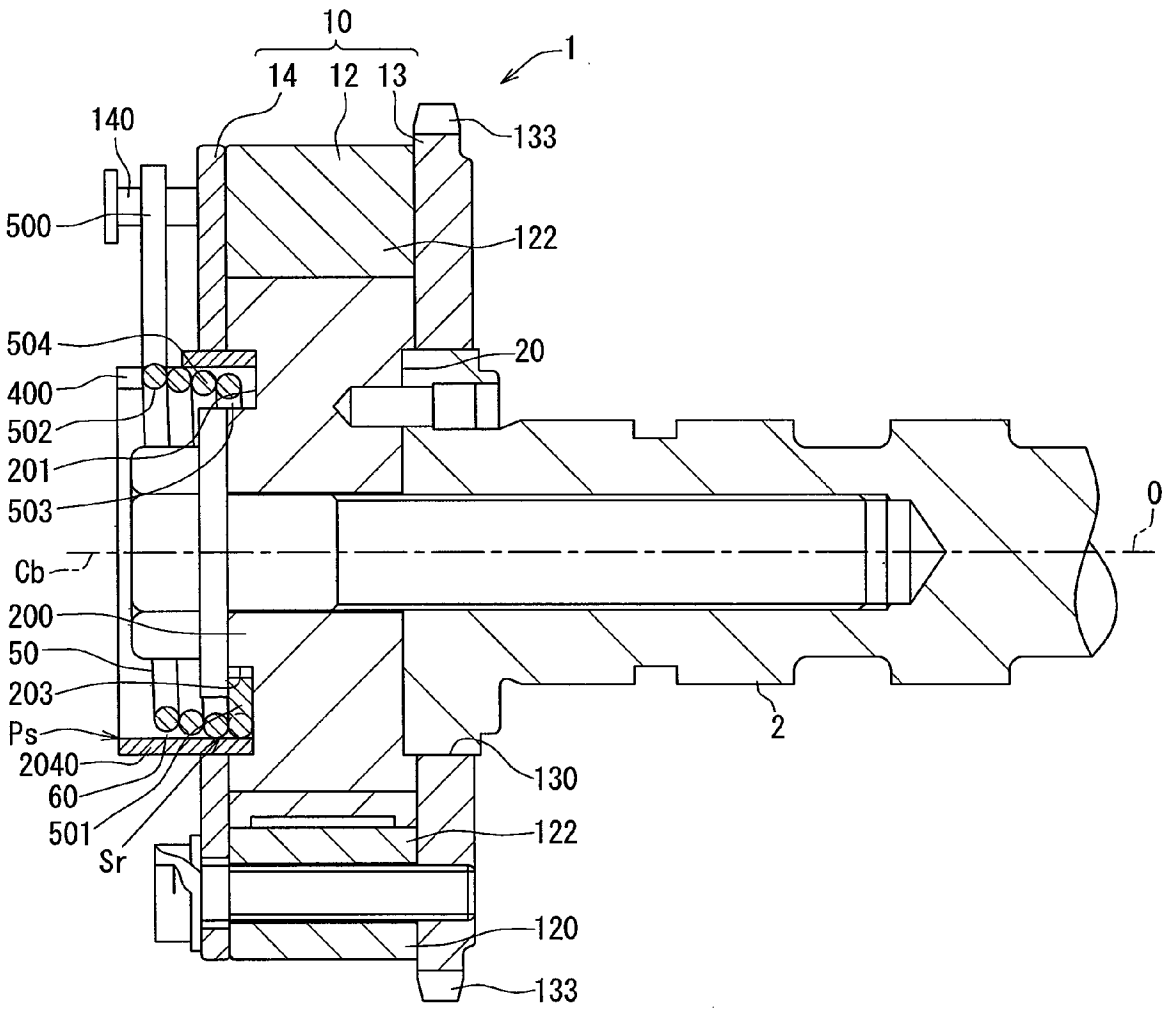
FIG. 7 is a sectional view illustrating a valve timing controller according to a second embodiment.

A second embodiment is a modification of the first embodiment, and is described with reference to FIG. 7.

The bush rotor 2040 of the second embodiment is arranged to range over from the inside to the outside of the outer rotor 10. The bush rotor 2040 is coaxially projected from the inner rotor 20 outside of the outer rotor 10 through the inner circumference side of the cover plate 14. While the internal-combustion engine is operated, the bush rotor 40 rotates integrally with the inner rotor 20 to one side in the circumferential direction around the rotation axis O. The bush rotor 2040 is fixed to the rotation shaft 200 produced separately as another object, and is able to rotate integrally with the rotation shaft 200. The bush rotor 2040 may be integrally formed with the rotation shaft 200. In the other aspects, the bush rotor 2040 is approximately the same as the bush rotor 40 of the first embodiment.

According to the second embodiment, the clearance 60 is defined between the bush rotor 2040 and the first turn 502 adjacent to the free end 500, at the specific position Ps in the maximum restoration state Sr, for the torsion coil spring 50 connected with both the rotors 10 and 20. Therefore, the same action and effect can be achieved as the first embodiment.

(Third Embodiment)

Figure 8:
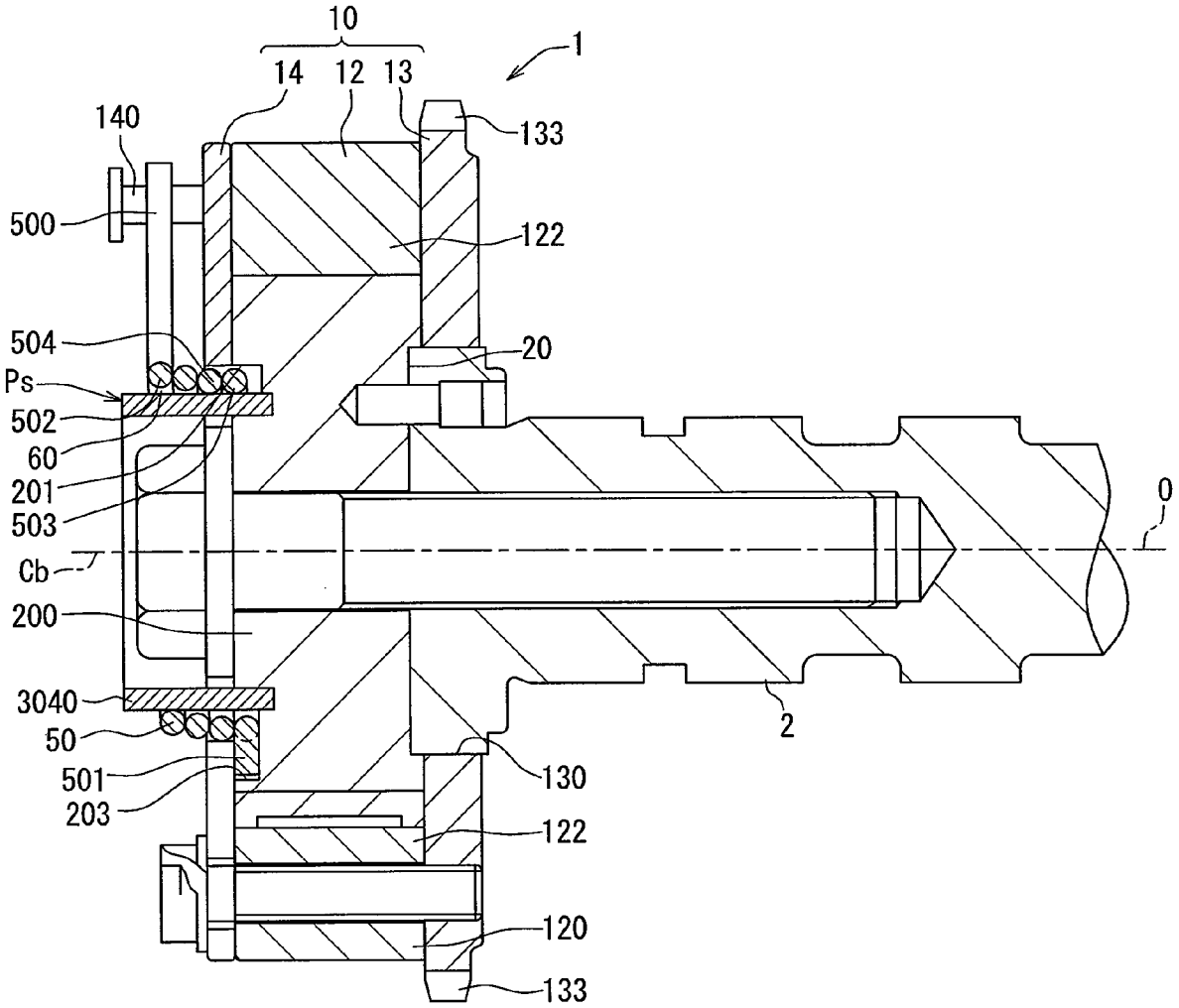
FIG. 8 is a sectional view illustrating a valve timing controller according to a third embodiment.

A third embodiment is a modification of the second embodiment, and is described with reference to FIG. 8.

In the third embodiment, the torsion coil spring 50 is arranged outside of the bush rotor 3040 projected from the inner rotor 20. Thereby, the bush rotor 3040 supports the torsion coil spring 50 on the outer side in the radial direction. Moreover, the cutout window 400 is not formed in the bush rotor 3040 of the third embodiment. Then, the free end 500 is bent radially outward from the first turn 502 adjacent to the free end 500, and is extended toward the connection stopper 140. Moreover, the specific position Ps is defined as the circumferential position around the rotation axis O where the free end 500 is set. In addition, in the third embodiment, the fixed end 501 is bent outward from a first turn 503 adjacent to the fixed end 501, and is fitted to the connection groove portion 203.

According to the third embodiment, the clearance 60 is defined between the first turn 502 adjacent to the free end 500 and the bush rotor 3040 at the specific position Ps in the maximum restoration state Sr for the torsion coil spring 50 engaged with both the rotors 10 and 20. Therefore, when the torsion coil spring 50 is torsionally deformed outside the bush rotor 3040, the first turn 502 is easily displaced away from the free end 500 through the rotation axis O. As a result, the first turn 502 is easily pressed onto the bush rotor 3040 at the specific position Ps defined as the circumferential position where the free end 500 is set. Therefore, the same action and effect can be achieved as the first embodiment.

(Other Embodiment)

Figure 9:
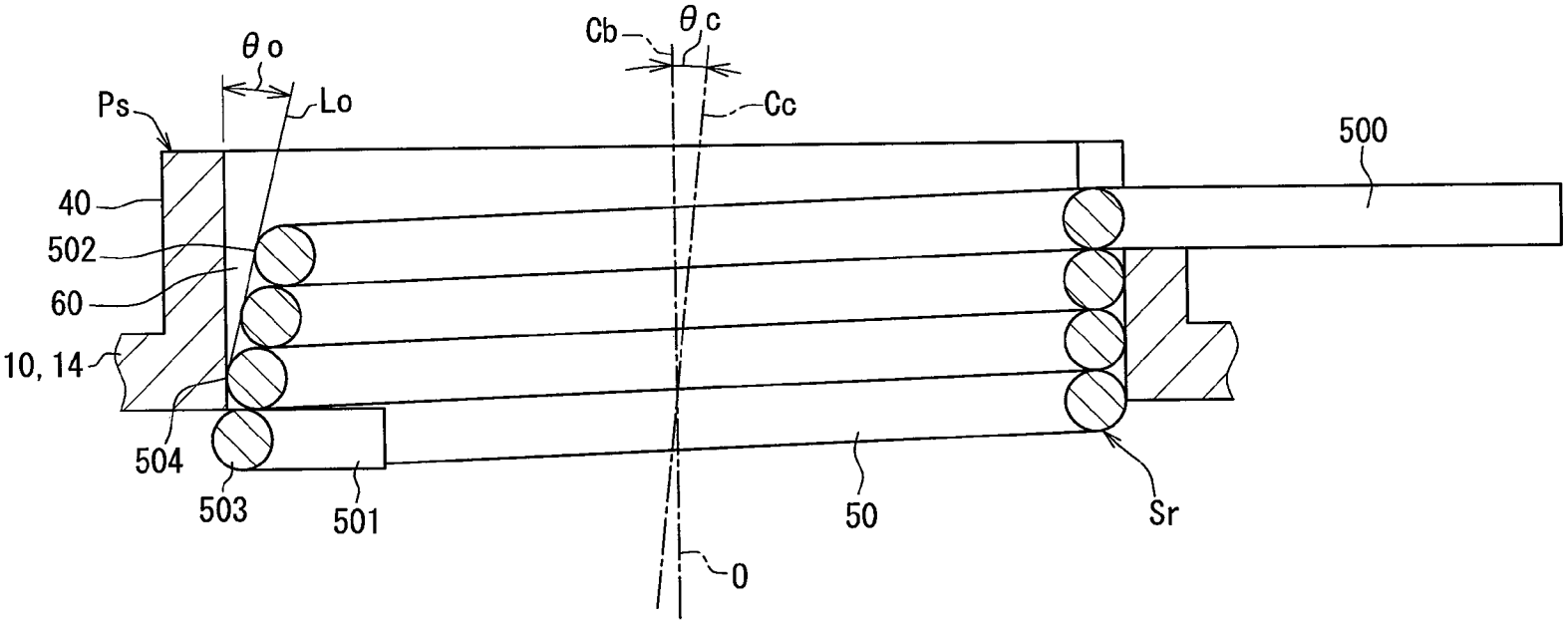
FIG. 9 is a sectional view illustrating a modification in FIG. 5.

As shown in FIG. 9, in a first modification about the first to third embodiments, the torsion coil spring 50 may be an odd-form coil in which the diameter of the coil is decreased from the fixed end 501 to the free end 500 and in which the coil axis Cc inclines toward the free end 500 relative to the rotation axis O. In this case, at the specific position Ps in the maximum restoration state Sr, the inclination angle θo of the tangent Lo to the rotation axis O is larger than the inclination angle θc of the coil axis Cc to the rotation axis O. In addition, FIG. 9 shows the first modification of the first embodiment.

Figure 10:
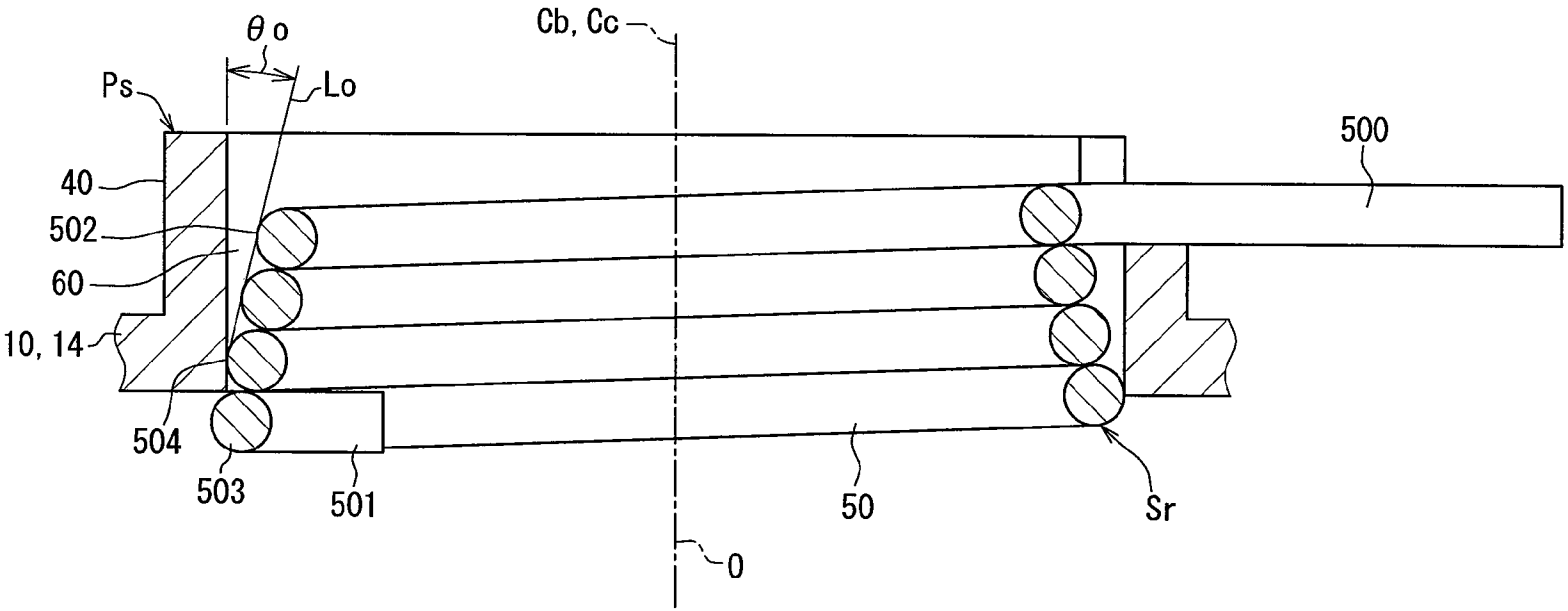
FIG. 10 is a sectional view illustrating a modification in FIG. 5.

As shown in FIG. 10, in a second modification about the first to third embodiments, the torsion coil spring 50 may be an odd-form coil having the coil axis Cc aligned with the rotation axis O in which the diameter of the coil is decreased from the fixed end 501 to the free end 500. In addition, FIG. 10 shows the second modification of the first embodiment.

Figure 11:
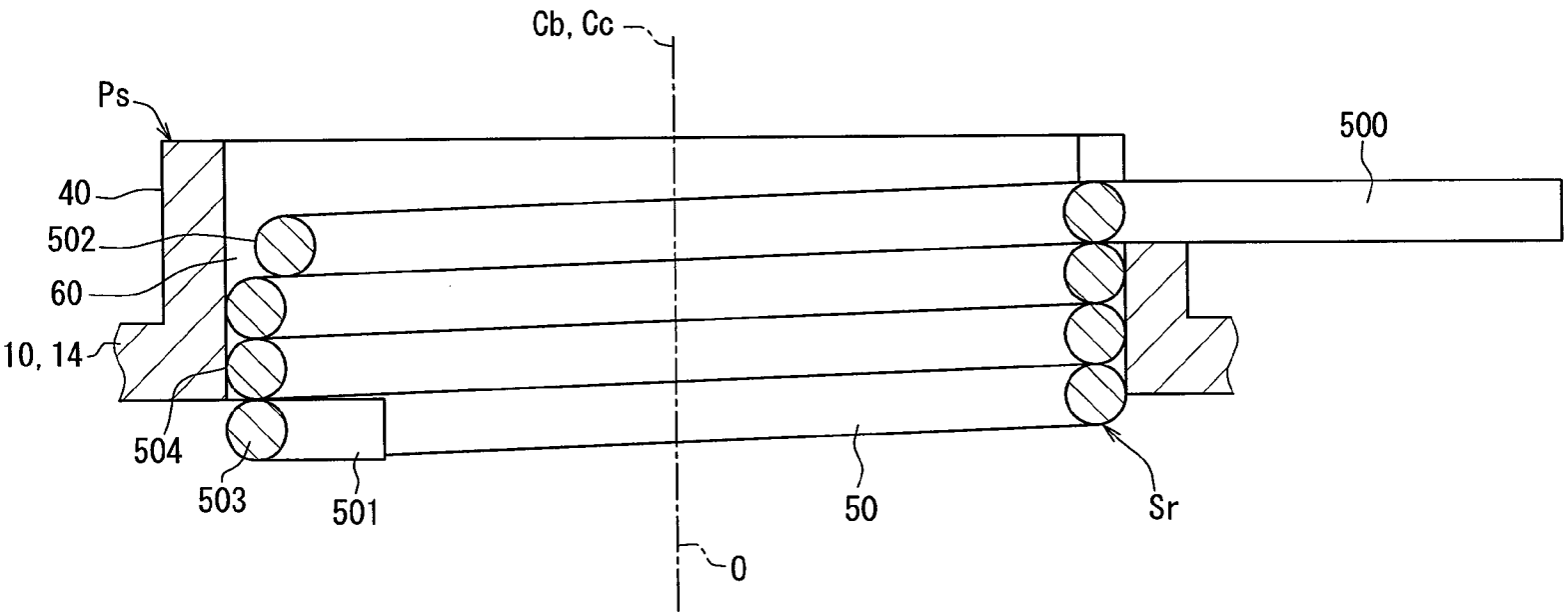
FIG. 11 is a sectional view illustrating a modification in FIG. 5.

As shown in FIG. 11, in a third modification about the first to third embodiments, the torsion coil spring 50 may be an odd-form coil having the coil axis Cc aligned with the rotation axis O in which the diameter of the coil is smaller at the free end 500 than at the wound part 504. In addition, FIG. 11 shows the third modification of the first embodiment, in which the diameter of the first turn 502 adjacent to the free end 500 is smaller than that of the other portion such as the wound part 504.

Figure 12:
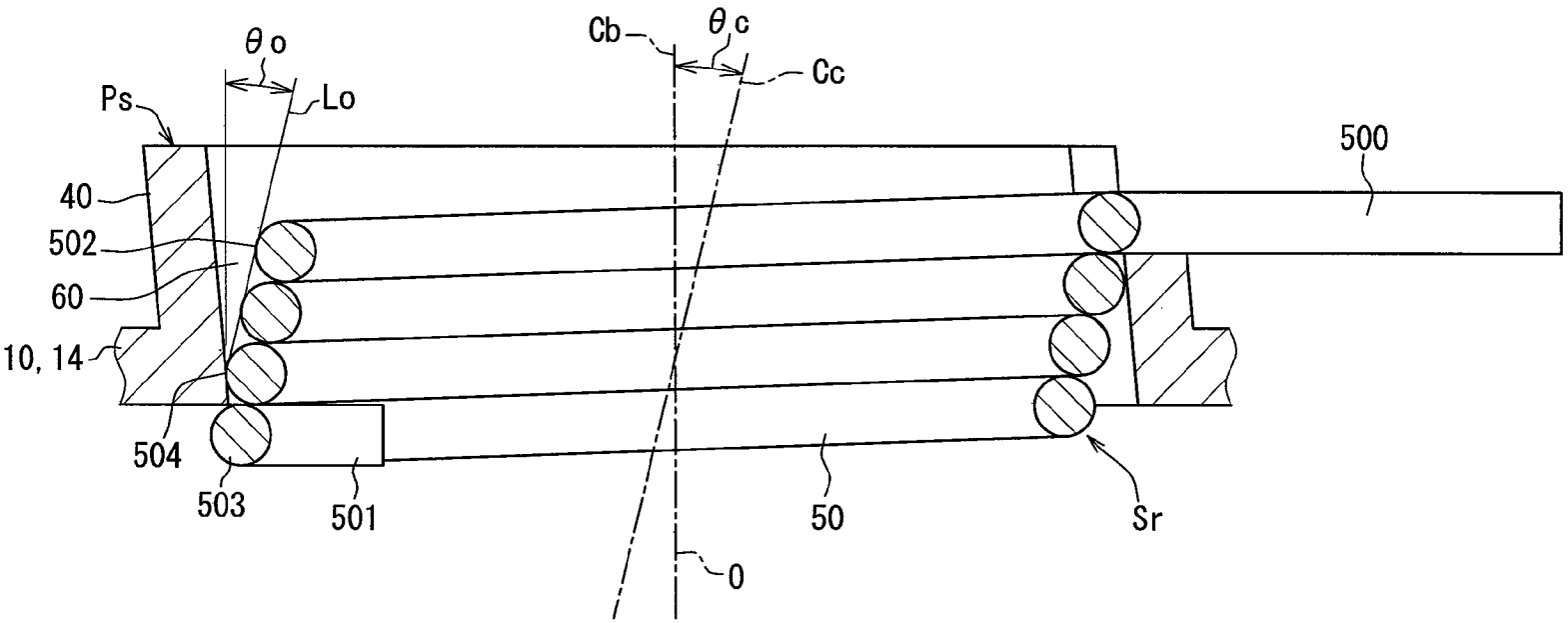
FIG. 12 is a sectional view illustrating a modification in FIG. 5.
Figure 13:
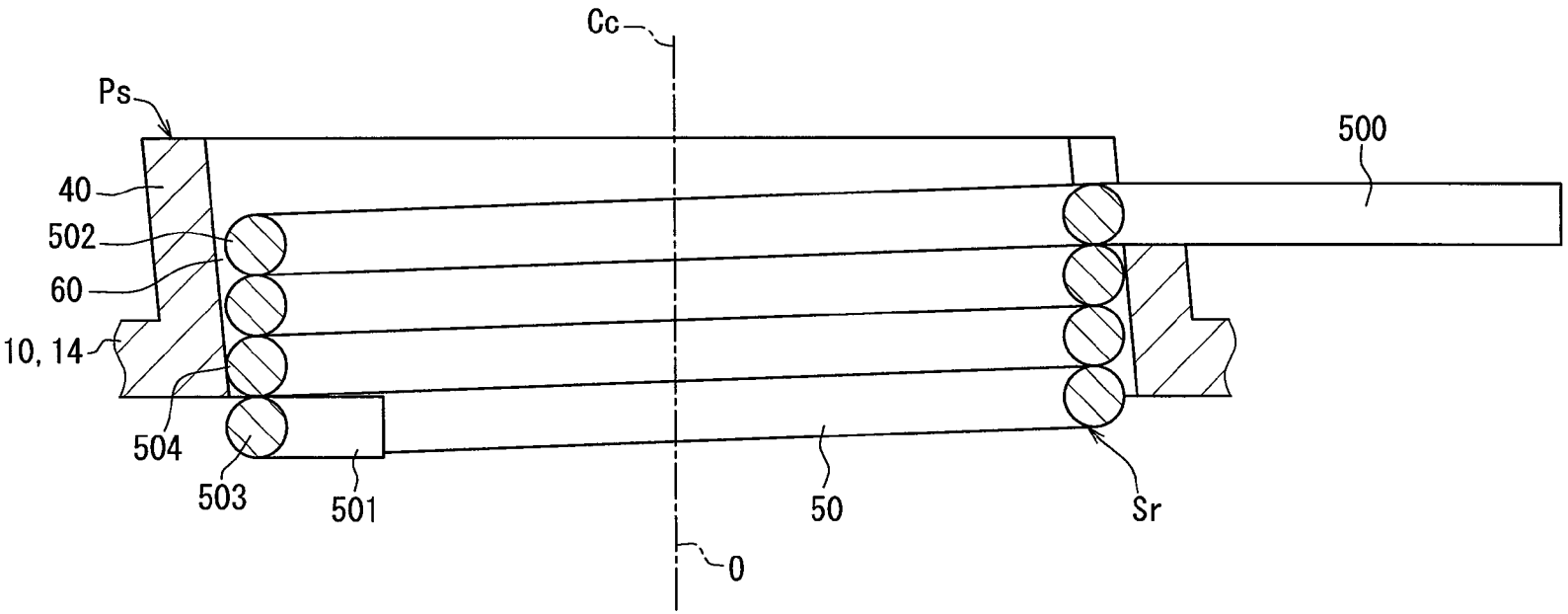
FIG. 13 is a sectional view illustrating a modification in FIG. 5.

As shown in FIGS. 12 and 13, in a fourth modification about the first to third embodiments, the bush rotor 40, 2040, 3040 may have an inclination cylinder shape with the center axis Cb inclined away from the free end 500 relative to the rotation axis O. In this case, as shown in FIG. 12, the torsion coil spring 50 may be wound in the shape of odd-form coil similarly to the first to third embodiments, or the first to third modifications described above. Alternatively, as shown in FIG. 13, the torsion coil spring 50 has the coil axis Cc aligned with the rotation axis O in which the diameter of the coil is approximately constant to present the shape of straight cylindrical coil.

In a fifth modification about the first to third embodiments, the clearance 60 is not defined. Specifically, the first turn 502 adjacent to the free end 500 contacts the bush rotor 40 at the specific position Ps in the maximum restoration state Sr, while the load relation of Fa<Fb is satisfied. In this case, the coil axis Cc is made inclined for the torsion coil spring 50 free from both the rotors 10 and 20 in a natural length state, for example, by an angle required for satisfying the load relation of Fa<Fb.

In a sixth modification about the first to third embodiments, the torsion coil spring 50 may be arranged to bias the inner rotor 20 on the retard side Dr relative to the outer rotor 10 while connected with the outer rotor 10. In this case, the connection stopper 140 is engaged with the free end 500 from the advance side Da.

In a seventh modification about the first to third embodiments, the torsion coil spring 50 may be deformed to bias the inner rotor 20 while being connected with the outer rotor 10 in a part of the relatively rotatable range. In this case, in the remainder of the relatively rotatable range, the torsion coil spring 50 is not connected with the outer rotor 10, and does not bias the inner rotor 20.

The valve timing controller may control the valve timing of an intake valve as a valve other than the exhaust valve.

Such changes and modifications are to be understood as being within the scope of the present disclosure as defined by the appended claims.

What is claimed is:

1. A valve timing controller that controls a valve timing of a valve opened and closed by a camshaft based on torque transfer from a crankshaft in an internal-combustion engine, the valve timing controller comprising:

an outer rotor that rotates with the crankshaft around a rotation axis;

an inner rotor that rotates with the camshaft around the rotation axis, the inner rotor relatively rotating inside of the outer rotor;

a torsion coil spring having a coil shape wound around the rotation axis, the torsion coil spring having a fixed end connected with the inner rotor, and a free end connected with the outer rotor, the torsion coil spring biasing the inner rotor while being connected with the outer rotor by being torsionally deformed according to a relative rotation of the inner rotor to the outer rotor; and a bush rotor coaxially projected from the outer rotor or the inner rotor, the bush rotor supporting the torsion coil spring in a radial direction, wherein a load acting from a first turn of the torsion coil spring adjacent to the free end is smaller than a load acting from a wound part of the torsion coil spring that is located between the first turn and the fixed end; wherein the torsion coil spring is in a maximum restoration state when the torsion coil spring is restored at the maximum while the torsion coil spring is connected with the outer rotor and the inner rotor, and a load acting from a first turn of the torsion coil spring adjacent to the free end is smaller than a load acting from a wound part of the torsion coil spring that is located between the first turn and the fixed end when the torsion coil spring is in the maximum restoration state.

2. The valve timing controller according to claim 1, wherein the bush rotor supports the torsion coil spring inside of the bush rotor, a specific position is defined at a circumferential position opposite to the free end through the rotation axis, and the load acting from the first turn adjacent to the free end to the bush rotor is smaller than the load acting from the wound part, at the specific position.

3. The valve timing controller according to claim 1, wherein the bush rotor supports the torsion coil spring outside of the bush rotor, a specific position is defined at a circumferential position at which the free end is set, and the load acting from the first turn adjacent to the free end to the bush rotor is smaller than the load acting from the wound part, at the specific position.

4. The valve timing controller according to claim 2, wherein the torsion coil spring is in a maximum restoration state when the torsion coil spring is restored at the maximum while the torsion coil spring is connected with the outer rotor and the inner rotor, and the load acting from the first turn adjacent to the free end to the bush rotor is smaller than the load acting from the wound part to the bush rotor, at the specific position when the torsion coil spring is in the maximum restoration state.

5. The valve timing controller according to claim 4, wherein a clearance is defined between the first turn adjacent to the free end and the bush rotor, and the wound part is in contact with the bush rotor, at the specific position when the torsion coil spring is in the maximum restoration state.

6. The valve timing controller according to claim 5, wherein the bush rotor has a cylindrical shape with a center axis aligned with the rotation axis, and the torsion coil spring comprises an odd-form coil having a coil axis inclined toward the free end relative to the rotation axis.

* * * * *